United States Patent [19]

Lehnert et al.

[11] Patent Number: 4,969,960

[45] Date of Patent: Nov. 13, 1990

[54] METHOD FOR INCREASING THE RESISTANCE TO THERMAL SHOCKS IN HEATING CONDUCTOR MATERIALS

[75] Inventors: Günter Lehnert; Friedrich Behr, both of Krefeld; Manfred Heinritz, Remscheid; Dieter Görres, Haan, all of Fed. Rep. of Germany

[73] Assignee: Thyssen Edelstahlwerke AG, Krefeld, Fed. Rep. of Germany

[21] Appl. No.: 308,211

[22] Filed: Feb. 9, 1989

[30] Foreign Application Priority Data

Feb. 12, 1988 [DE] Fed. Rep. of Germany ..... 3804359

[51] Int. Cl.[5] ..... B01J 23/78; B23P 17/00; C23C 8/02; C23C 8/10

[52] U.S. Cl. ..... 148/284; 148/286; 148/287; 502/439

[58] Field of Search ..... 148/284, 285, 286, 287; 502/439

[56] References Cited

U.S. PATENT DOCUMENTS

| | | | |
|---|---|---|---|
| 4,318,828 | 3/1982 | Chapman | 148/284 |
| 4,915,751 | 4/1990 | Vaneman | 502/439 |

FOREIGN PATENT DOCUMENTS

| | | |
|---|---|---|
| 9156 | 9/1979 | European Pat. Off. . |
| 0184311 | 6/1986 | European Pat. Off. . |
| 2063723 | 6/1981 | United Kingdom . |
| 2085034 | 4/1982 | United Kingdom . |
| 2093073 | 8/1982 | United Kingdom . |
| 2094838 | 9/1982 | United Kingdom . |
| 2152082 | 12/1983 | United Kingdom . |

OTHER PUBLICATIONS

Stahl-Eisen-Liste, Verlag Stahleisen m.b.H., Dusseldorf, 1977, Dr.-Ing. Hans Schmitz.

*Primary Examiner*—Jay H. Woo
*Assistant Examiner*—Jeremiah F. Durkin, II
*Attorney, Agent, or Firm*—Cushman, Darby & Cushman

[57] ABSTRACT

A method for increasing the resistance to thermal shocks of the oxide layer of metallic heat conductive materials which contain 3% to 10% aluminum, 10% to 26% chromium, up to 3% zirconium and/or titanium and/or hafnium and/or niobium and/or silicon and/or 0.002% to 0.3% total of rare earths and/or yttrium in metallic form or as finely dispersed oxides, the remainder being iron and/or nickel and/or cobalt as well as the trace elements normally present in steels. The materials develop primarily aluminum oxide and/or chromium oxide on the surface when heated in a temperature range of 700° C. to 1350° C. in an oxygen-containing atmosphere. The materials are first heated in an oxygen-free atmosphere under conditions which cause recrystallization in their surface zone. They then are oxidized in an atmosphere which contains oxygen in chemically bound form.

10 Claims, No Drawings

METHOD FOR INCREASING THE RESISTANCE TO THERMAL SHOCKS IN HEATING CONDUCTOR MATERIALS

The present invention relates to a method for increasing the resistance to thermal shocks in the oxide layer and therewith for improving the oxidation behavior of heat conductive materials.

BACKGROUND OF THE INVENTION

Metallic materials are known which contain 3 to 10% aluminum and 10 to 25% chromium, as well as one or more reactive elements of the row of silicon and/or zirconium and/or hafnium and/or titanium, in an amount less than 5%, and/or one or more of the rare earth elements in an amount less than 0.3%, and/or alkaline earth metals of the group Mg, Ba, Ca, Sr and Be in an amount between 0.001 and 1% as well as the trace elements normally present in steels, the remainder of the alloy being iron and/or nickel and/or cobalt. When the surface has been oxidized, the oxide layer produced on such alloys is designed to be rough so that it can also function in an advantageous manner as an adhesive base for further coatings, e.g. also for usage as catalytic carrier.

Metallic alloys of the type M Cr Al X and of the type M Cr Al Z X, in which M is iron and/or cobalt and/or nickel, and X represents small additives, weightwise, of highly reactive elements such as Y, Zr, Ti, Ce, Sm, Hf, La, Th, U, V, W, Ta, Nb, Mo, Gd, Si, Mg, Ca, and Z, which is present as an element or its oxide, is from the same row as X but which is an element different from that selected for X. These alloys have improved oxide layer properties (see Straford, K. N., "High Temperature Corrosion of Alloys Containing Rare Earth of Refractory Elements: A Review . . . ", High Temperature Technology, Vol. 1, No. 6, November 1983). In these alloys, the adhesion of the oxide layer is improved and thus the rate of oxidation is decreased.

It is also known that oxides of the rare earths such as $Y_2O_3$, which are especially finely dispersed in a base alloy, exert a similar, improving influence (See Ramanarayan, T. A., Raghavan, M. and Petkovic-Luton, R., "The Characteristics of Alumina Scales Formed on Fe-Based Yttria-Dispersed Alloys", J. Electrochem. Society, April 1984, Vol. 131, No. 4, pp. 923–931).

Shell-shaped oxide can be produced in a known manner by special heat treatments on the surface of metallic materials from the latter. Thus, for example, published European Patent Application EP-A No. 009156 describes how whisker-shaped oxides can be produced from ferritic steels containing more than 0.002% of rare earths if they are exposed to a long-lasting oxidation in preferably dry air at approximately 900° to 930° C. A similar state of the art is also described in British Patent No. 2,063,723. The disadvantage of this technique resides in the necessity of having to add rare earths in order to increase the adhesive strength of the different types of oxide layers of the alloy of the metal. Rare earths are not only expensive but they also react in the course of the manufacturing process of the semi-finished product with oxygen, impurities and the crucible materials so that high losses arise.

SUMMARY OF THE INVENTION

The object of the present invention is to provide a method with which the adhesive strength of the oxide layer of heat-resistant steels which contain chromium and aluminum can be improved in such a manner that the content of rare earth metals can be reduced or eliminated for many applications.

These and other objects are achieved in an alloy which contains 3% to 10% aluminum, 10% to 26% chromium, up to 3% zirconium and/or titanium and/or hafnium and/or niobium and/or silicon, and/or 0.002% to 0.3% in sum of rare earths and/or yttrium in metallic form or as finely dispersed oxides, remainder iron and/or nickel and/or cobalt as well as the trace elements customary in steels.

The process consists of first heating the materials or components consisting of the materials in an oxygen-free atmosphere under conditions which cause recrystallization in their surface zone (thermal etching). Then, the materials can be oxidized, preferably in an atmosphere containing oxygen in chemically bound form which atmosphere contains a maximum of 1% free molecular oxygen.

It has been found possible to considerably improve the adhesion of the oxide layer which is formed with these heat treatments. The maintenance of a good vacuum, especially with a low leakage rate of the vacuum device of less than or equal to $10^{-4}$ mbar.l)/s measured with the helium covering test at room temperature, or heat treatment in a high-purity inert gas, achieves recrystallization of the individual metal grains on the surface and forms a roughness on the order of 0.1 to 3 μm, depending on the pretreatment. The roughness forms the base for an increased adhesion of the oxide layer which is formed subsequently.

The oxide layer should consist, e.g. in the case of material described on page 120 of the annex Stahl-Eisen-Liste (Steel-Iron-List), (1977) 1.4767 which contains approximately 5% aluminum, of more than 96% aluminum oxide. This is achieved in accordance with the invention in that the material is heated at 700° to 1350° C. in an atmosphere containing oxygen in a chemically bound form. The atmosphere can consist of hydrogen-water vapor mixtures or of a mixture of these gases together with carbon dioxide and carbon monoxide, e.g. flue gas having a reducing composition. It is preferable to use carbon dioxide with as little oxygen as possible from which a carbon dioxide-carbon monoxide mixture forms during the oxidation.

The procedure which has been found to be the most advantageous uses, as a starting material, a foil (45μm thick) for catalytic carriers for motor vehicles consisting of material 1.4767, starting with the wound and optionally soldered body. The process for this material consists of:

(1) Annealing at 1240° to 1280° C. in a high vacuum with a leakage rate with the helium covering test of the device of $\leqq 5 \cdot 10^{-5}$ (mbar.l)/s at room temperature or in an appropriately oxygen-free inert gas, (2) Annealing with oxidation under carbon dioxide (degree of purity relative to free oxygen greater than or equal to 99.95%) at 800° to 930° C., preferably at 875° to 925° C., (3) The customary annealing in air or in any oxygen-containing atmosphere at a temperature above 800° C., better yet at a temperature above 1000.° C.

A thin layer of almost pure aluminum oxide is formed in step (2). Further absorption of oxygen is considerably retarded in the case of semi-finished products and components whose use temperature is e.g. approximately 700° to 950° C.

Steps (2) and (3) can also be carried out with the aid of flue gas which is weakly reducing, e.g. the gas from an acetylene burner.

It has also proven to be advantageous if the heat conductive materials contain small amounts of zirconium, titanium or hafnium. It is preferable to use 0.1 to 0.2% zirconium and titanium (0.1 to 0.15%). A further improvement is achieved if rare earths or alkaline earth metals are present in the alloy used as a starting material. In this manner, the questionable use of rare earths can frequently be avoided.

The method can be carried out in a suitable vacuum furnace in combination with the oxidizing treatment in flue gases set to be reducing. However, in order to obtain uniform oxide-layer thicknesses, it is preferable to use a two-chamber vacuum furnace in the production of components which exhibit a large specific surface such as catalytic carriers which consist of wound or stacked, corrugated foils. One chamber of the furnace is used for the high-temperature treatment under a vacuum and other furnace chamber is used for the oxidation with the aid of chemically bound oxygen. In this manner, the method can be carried out in a single cycle.

What is claimed is:

1. A method of increasing the resistance to thermal shocks of the oxide layer of metallic heating conductor materials comprising:

(i) 3% to 10% aluminum (ii) 10% to 26% chromium; and (iii) remainder iron or nickel or cobalt said method comprising:

(a) heating the materials in an oxygen-free atmosphere under conditions which cause recrystallization in their surface zone; and (b) heating the materials to a temperature in the range of 700° C. to 1350° C. in an oxygen-containing atmosphere the maximum amount in sum of ytrium and rare earths in said metallic heating conductor materials being 0.3%.

2. A method as set forth in claim 1 in which the oxygen-containing atmosphere contains oxygen in chemically bound form and a maximum of 1% free molecular oxygen.

3. A method as set forth in claim 1 in which the heating under conditions which cause recrystallization is carried out in a vacuum.

4. A method as set forth in claim 1 in which the heating under conditions which cause recrystallization is carried out in an oxygen-free atmosphere which contains an inert gas which has a purity of more than 99.9% relative to gaseous components containing oxygen.

5. A method as set forth in any one of claims 2, 3, 4 or 1 in which the oxidation is carried out in an atmosphere which contains oxygen chemically bound in the form of carbon dioxide ($CO_2$).

6. A method as set forth in any one of claims 2, 3, 4, or 1 in which the oxidizing is first performed for 0.1 to 6 hours at 800° to 930° C. in $CO_2$ and then at 950° to 1350° C. for 5 to 60 minutes.

7. A method as set forth in any one of claims 2, 3, 4, or 1 in which the treated material is in the form of a heat conductor foil constructed and arranged for a catalytic carrier or a carbon black filter.

8. A method as set forth in claim 1 in which the heat treatment is carried out in the first chamber of a two-chamber furnace and the oxidation is carried out in the second chamber of said furnace.

9. The method according to claim 1 where said heating conductor materials further comprises at least one of:

(i) up to 3% zirconium or titanium or hafnium or niobium or silicon; or (ii) 0.002% to 0.3% in sum of rare earths; or (iii) yttrium in metallic form or as finely dispersed oxides.

10. The method as set forth in any one of claims 2, 3, 4 or 9 in which the materials which are treated contain less than 0.002% of rare earth elements but more than 0.001% and up to 0.099% of an alkaline earth metal selected from the group consisting of Ba, Mg, Ca, Sr and Be and optionally 0.1% to 0.5% each of Zr and Ti.

* * * * *